US008776742B2

(12) United States Patent
Sakane

(10) Patent No.: US 8,776,742 B2
(45) Date of Patent: Jul. 15, 2014

(54) VALVE TIMING CONTROL APPARATUS FOR INTERNAL COMBUSTION ENGINE

(75) Inventor: Taisuke Sakane, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 118 days.

(21) Appl. No.: 13/333,204

(22) Filed: Dec. 21, 2011

(65) Prior Publication Data

US 2012/0160196 A1 Jun. 28, 2012

(30) Foreign Application Priority Data

Dec. 24, 2010 (JP) ..... 2010-286906

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34469* (2013.01)
USPC ..... 123/90.17

(58) Field of Classification Search
CPC ..... F01L 2001/34469; F01L 1/3442; F01L 2001/3443; F01L 2001/34453
USPC ..... 123/90.15, 90.16, 90.17; 464/1, 2, 160; 74/567, 568 R
See application file for complete search history.

(56) References Cited

U.S. PATENT DOCUMENTS 2,616,274 A * 11/1952 Landrum ..... 464/57
RE28,562 E * 9/1975 Holst et al. ..... 303/61
5,558,053 A * 9/1996 Tortul ..... 123/90.17
5,558,063 A * 9/1996 Minagawa et al. ..... 123/457
6,035,819 A * 3/2000 Nakayoshi et al. ..... 123/90.17
6,039,016 A * 3/2000 Noguchi ..... 123/90.17
6,155,219 A 12/2000 Fukuhara et al.
6,382,156 B1 * 5/2002 Fukuhara et al. ..... 123/90.17
6,386,164 B1 * 5/2002 Mikame et al. ..... 123/90.17
6,443,112 B1 * 9/2002 Kinugawa ..... 123/90.17
6,779,499 B2 * 8/2004 Takenaka et al. ..... 123/90.17
7,059,286 B2 6/2006 Kusano et al.
7,100,555 B2 * 9/2006 Imaizumi et al. ..... 123/90.17
7,210,440 B2 * 5/2007 Lawrence et al. ..... 123/90.6
7,503,294 B2 3/2009 Ogawa et al.
2002/0100445 A1 8/2002 Takenaka et al.
2007/0056539 A1 * 3/2007 Fischer et al. ..... 123/90.17

(Continued)

FOREIGN PATENT DOCUMENTS

JP 2000-145415 A 5/2000
JP 2002-227621 A 8/2002

(Continued)

OTHER PUBLICATIONS

Japanese Office Action dated Feb. 5, 2013 (two (2) pages).

*Primary Examiner* — Kenneth Bomberg
*Assistant Examiner* — Jason T Newton
(74) *Attorney, Agent, or Firm* — Crowell & Moring LLP

(57) ABSTRACT

In a valve timing control apparatus for an internal combustion engine, a torsion spring whose one end section is fixed into a front side of a housing and whose other end section is fixedly retained into a communication hole to bias a vane member to rotate in one direction, the communication hole being formed in an inner axial direction of the vane member to introduce a working oil within the back pressure into the engine.

6 Claims, 4 Drawing Sheets

(56) References Cited

U.S. PATENT DOCUMENTS

| | | | | |
|---|---|---|---|---|
| 2007/0062474 | A1* | 3/2007 | Lipke et al. | 123/90.17 |
| 2007/0095199 | A1 | 5/2007 | Ogawa et al. | |
| 2009/0056655 | A1* | 3/2009 | Kobayashi et al. | 123/90.17 |
| 2009/0090322 | A1* | 4/2009 | Kokubo et al. | 123/90.17 |
| 2012/0234275 | A1* | 9/2012 | Fischer et al. | 123/90.17 |

FOREIGN PATENT DOCUMENTS

| | | | |
|---|---|---|---|
| JP | 2002-295208 | A | 10/2002 |
| JP | 2003-83012 | A | 3/2003 |
| JP | 2005-146911 | A | 6/2005 |
| JP | 2005-180378 | A | 7/2005 |
| JP | 2006-125318 | A | 5/2006 |
| WO | WO 2005/061859 | A1 | 7/2005 |

* cited by examiner

VALVE TIMING CONTROL APPARATUS FOR INTERNAL COMBUSTION ENGINE

BACKGROUND OF THE INVENTION (1) Field of the Invention

The present invention relates to a valve timing control apparatus for an internal combustion engine which is capable of variably controlling an open-and-closure timing of an engine valve which is an intake valve or an exhaust valve of the internal combustion engine in accordance with a driving condition of the engine.

(2) Description of Related Art

A generally available vane type valve timing control apparatus is structured for a vane member to be stable at a retardation angle side with respect to a timing sprocket caused by an alternating torque generated on a camshaft, in a state in which an operational force according to a hydraulic pressure is not generated in such a case of at a time of an engine stop.

However, in recent years, as disclosed in a previously proposed valve timing control apparatus, for example, as described in a Japanese Patent Application First Publication (tokkai) No. 2005-180378 published on Jul. 7, 2005 (which corresponds to a United States Patent Application Publication No. 2007/0095199 published on May 3, 2007), in a case where the operational force according to the hydraulic pressure is not generated, a spring force of a torsion spring causes a vane member to be mechanically stabilized toward an advance angle side or the operational force is assisted in the advance angle direction.

The torsion spring described in the above-described Japanese Patent Application First Publication No. 2005-180378 has one end bent toward an outside of a radial direction of the torsion spring and is fixedly retained in a retaining groove which is exclusively used for a retaining purpose and is installed on a housing and, on the other hand, has the other end bent toward an inside of the radial direction thereof and is fixedly retained into a retaining groove which is exclusively used for the retaining purpose and is installed on the vane member.

SUMMARY OF THE INVENTION

However, in the previously proposed valve timing control apparatus described above, it is necessary to individually form each of the retaining grooves in which the one end and the other end of the torsion spring are is respectively fixedly retained only for the retaining purposes.

It is, therefore, an object of the present invention to provide a valve timing control apparatus which is capable of facilitating a manufacturing work by using a communication hole for an oil exhaust purpose as a retaining hole into which one end of the torsion spring is fixedly retained (engageably inserted and fixed).

According to one aspect of the present invention, there is provided with a valve timing control apparatus for an internal combustion engine, comprising: a housing to which a turning force is transmitted from a crankshaft via a timing belt and at an inner peripheral side of which a plurality of working oil chambers are disposed; a vane member coupled to a tip end of a camshaft and relatively rotatably disposed within the housing; a lock piston disposed axially movably in an inner part of the vane member and whose axial tip end is retractably advanced toward a rear side of the camshaft; a biasing member disposed within a back pressure chamber disposed in a front side of the camshaft opposite to the camshaft to bias the lock piston to be advanced toward the rear side of the camshaft; a limiting section on which the axial tip end of the lock piston is contacted to limit a relative rotation of the vane member to the housing; a communication hole formed in an inner axial direction of the vane member to introduce a working oil within the back pressure chamber into the engine; and a torsion spring whose one end section is fixed into the front side of the housing and other end section is fixedly retained into the communication hole to bias the vane member to rotate in one direction.

According to another aspect of the present invention, thee is provided with a valve timing control apparatus for an internal combustion engine, comprising: a driving rotary body to which a turning force is transmitted from a crankshaft; a driven rotary body installed relatively rotatably on the driving rotary body; a lock piston installed in one side of the driving rotary body and the driven rotary body to be retracted when a quantity of a supplied working liquid to the apparatus is equal to or larger than a predetermined quantity and to be advanced when the quantity of the supplied working liquid is smaller than the predetermined quantity; a biasing member for biasing the lock piston to be advanced; a limiting section installed on the other side of the driving rotary body and the driven rotary body and on which a tip end section of the lock piston is contacted to limit a relative revolution of the driven rotary body to the driving rotary body; a back pressure chamber installed on the one side of the driven rotary body to the driving rotary body and in an inside of which the biasing member is housed; a back pressure passage which communicates between the back pressure chamber and an external; and a torsion spring one end thereof being engageably inserted and fixed onto a position constituting part of the back pressure passage and the other end thereof being fixed onto either one of the driving and driven rotary bodies on which the back pressure chamber is formed.

According to a still another aspect of the present invention, there is provided with a valve timing control apparatus for an internal combustion engine, the valve timing control apparatus being driven by a hydraulic pressure and comprising: a torsion spring acting a biasing force in a direction at which a valve open-and-closure timing of an engine valve is modified, at least one end of the torsion spring being engageably inserted and fixed to a hole combining an oil passage.

DETAILED DESCRIPTION OF THE INVENTION

Reference will, hereinafter, be made to the drawings in order to facilitate a better understanding of the present invention, namely, a preferred embodiment of a valve timing control apparatus for an internal combustion engine. In this embodiment, the valve timing control apparatus (abbreviated as VTC) is applied to a variably operated valve apparatus in an exhaust valve side of the engine.

Figure 1:
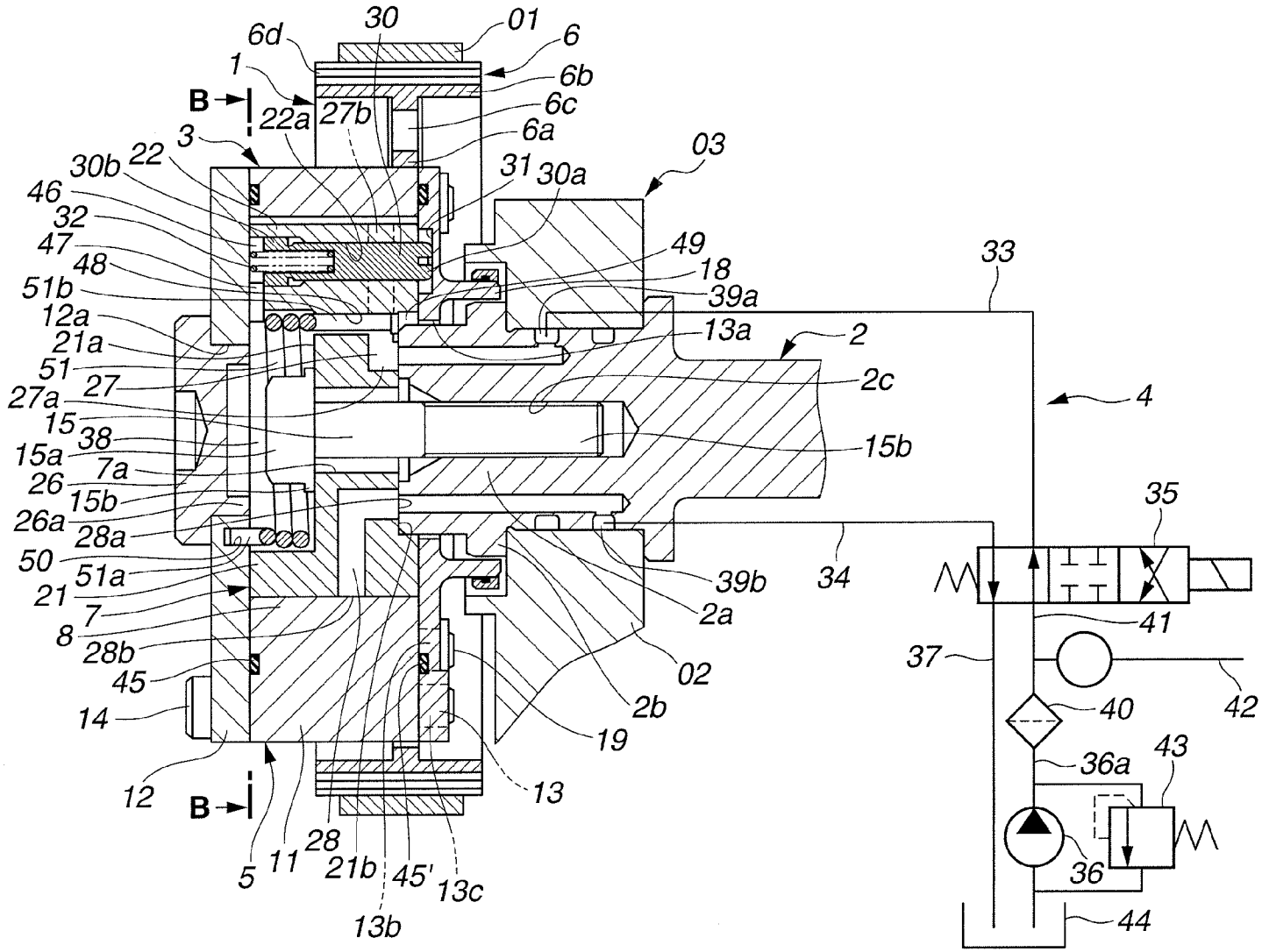
FIG. 1 is a cross sectional view of a valve timing control apparatus according to the present invention in a preferred embodiment cut away along a line of A-A in FIG. 2.
Figure 2:
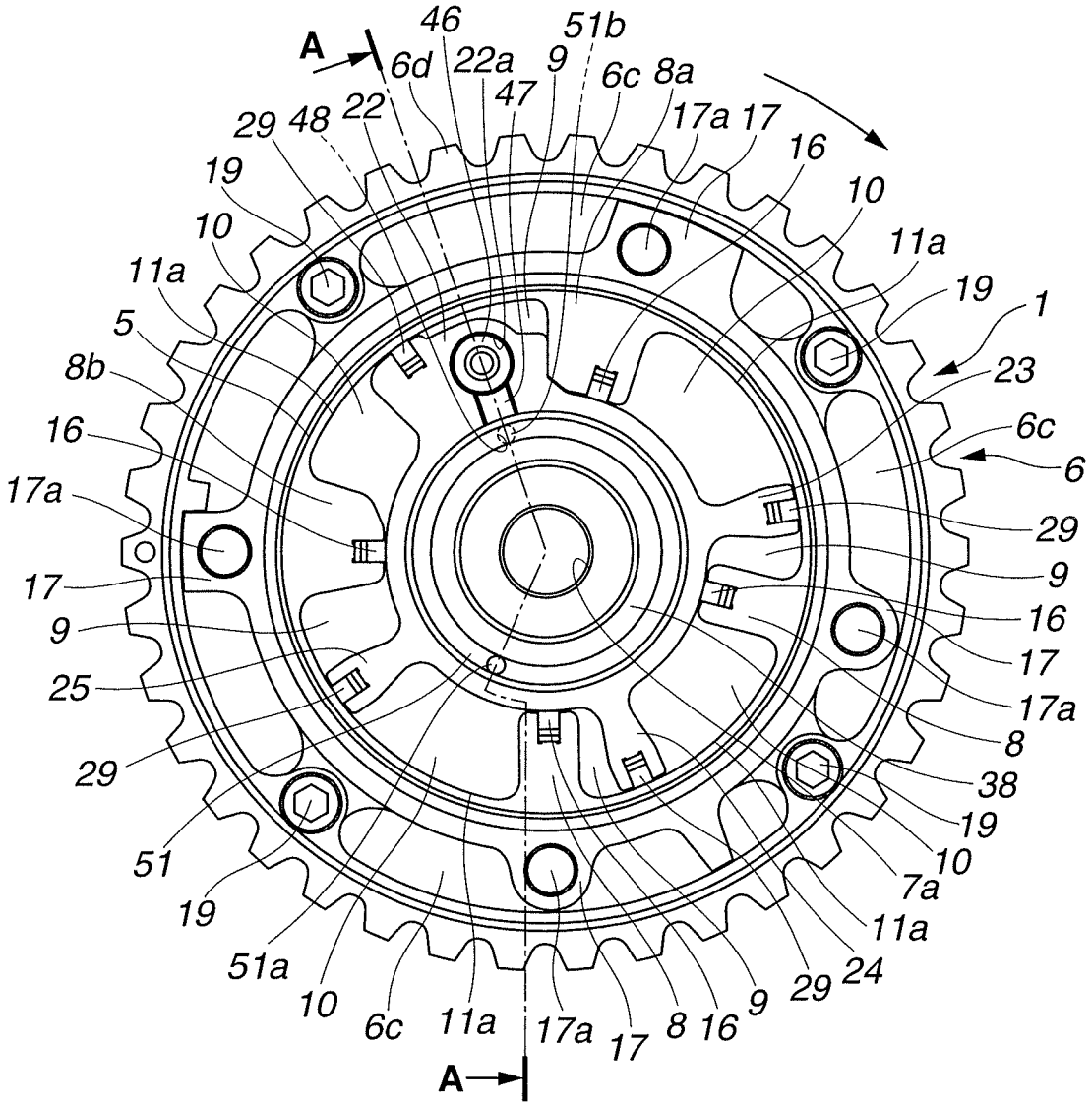
FIG. 2 is a cross sectional view cut away along a line of B-B in FIG. 1 representing an operation state toward a most advance angle side of the valve timing control apparatus in the preferred embodiment.
Figure 3:
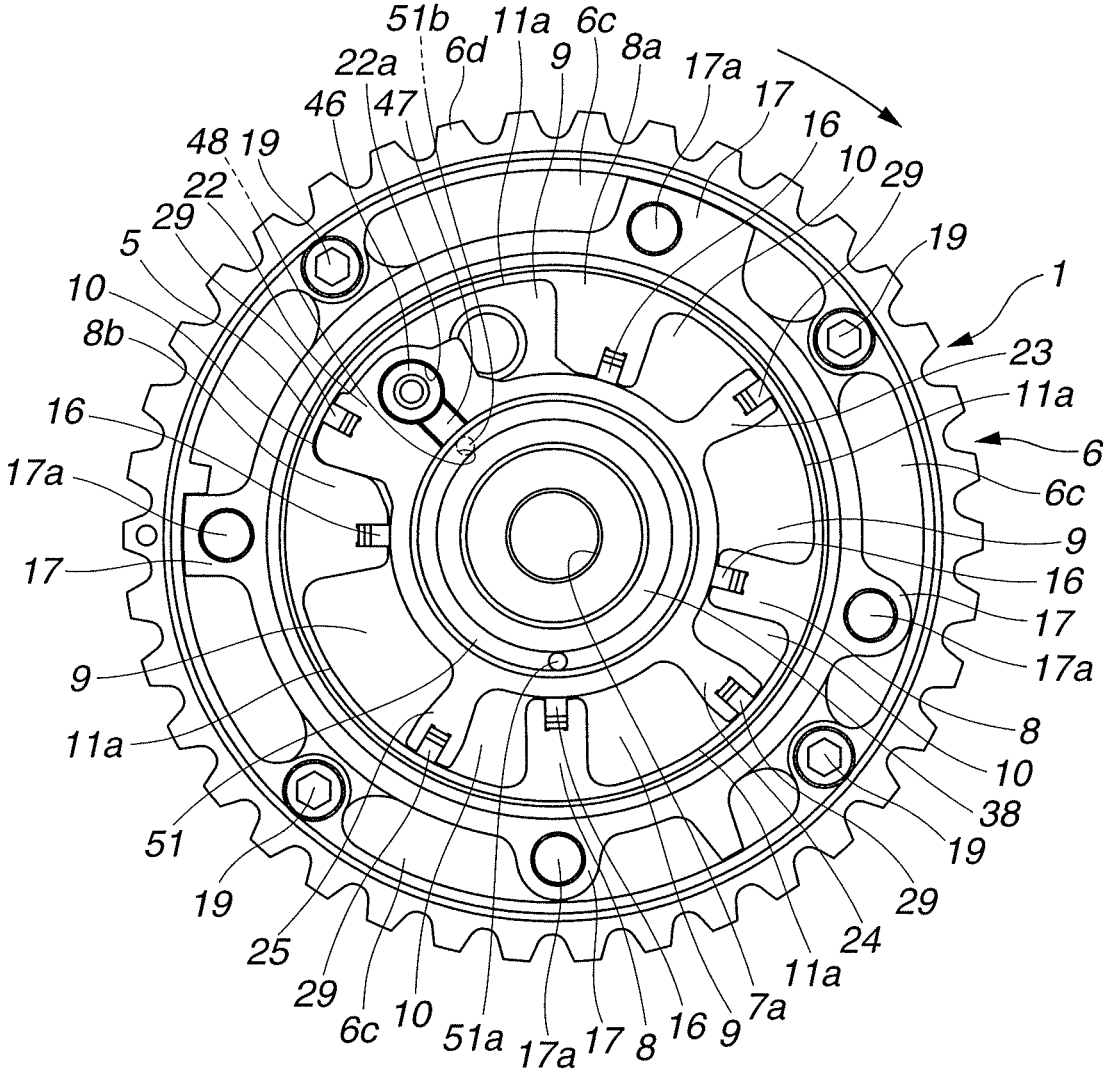
FIG. 3 is a cross sectional view cut away along a line of B-B in FIG. 1 representing another operation state toward a most retardation angle side of the valve timing control apparatus in the preferred embodiment.

That is to say, the exhaust valve side VTC, as shown in FIGS. 1 through 3, includes a timing pulley 1 which is a driving rotary body and to which a turning force is transmitted via a timing belt 01 by means of a crankshaft not shown; an exhaust camshaft 2 which is a driven rotary body disposed relatively rotatably with respect to timing pulley 1; a phase conversion mechanism 3 disposed between timing pulley 1 and exhaust camshaft 2 to convert a relative rotary phase of both pulley 1 and camshaft 2; and a hydraulic pressure circuit 4 actuating phase conversion mechanism 3.

Timing pulley 1 is constituted by a housing 5 which constitutes part of phase conversion mechanism 3 as will be described later and a plurality of members such as a pulley member 6 fixed onto an outer periphery of housing 5 and is rotated in an arrow-marked direction as shown in each of FIGS. 2 and 3.

Exhaust camshaft 2 is rotatably supported on a cylinder head 02 via a cam bearing 03. A plurality of drive cams which open the exhaust valve via a direct drive type valve lifter (not shown) is integrally installed on a predetermined position of an outer peripheral surface of exhaust camshaft 2. In addition, a thick ring-shaped flange 2*b* is integrally installed at one end section 2*a* of exhaust camshaft 2. Furthermore, a female screw hole 2*c* into which a male screw of a shaft section 15*b* of a cam bolt 15 to fix a vane member 7, as will be described later, to a tip end of one end section 2*a* of camshaft 2 through an axial direction thereof is screwed is formed on an inside axial direction of one end section 2*a* of camshaft 2.

Pulley member 6 is constituted by: an annular section 6*a* disposed at a center position in a width direction thereof on an inner peripheral surface of pulley member 6; and a cylindrical section 6*b* integrally disposed along an outer periphery of annular section 6*a*. Four bolt is penetrating holes not shown through which bolts 19 are inserted to be coupled to a rear plate 13 as will be described later are axially penetrated through annular section 6*a* at a position of each of 90° in a circumferential direction of annular section 6*a*. A plurality of arc shaped lightening holes 6*c* are formed to lighten weight of pulley member 6 on both sides of the respective bolt penetrating holes. Corrugated meshing sections 6*d* on an outer periphery of which timing belt 01 is meshed are formed on an outer periphery of cylindrical section 6*b*.

Phase conversion mechanism 3 is provided with housing 5 arranged at one end section 2*a* side of camshaft 2; vane member 7 fixed to one end section 2*a* of camshaft 2 from the axial direction through cam bolts 15 and relatively rotatably housed within housing 5; four shoes 8 projected from an inner peripheral surface of hosing 5 toward the inner direction of housing 5; and four retardation angle oil chamber 9 and four advance angle oil chambers 10 partitioned by four vanes 22 through 25 of respective shoes 8 and vane members 7 as will be described later.

Housing 5 is provided with a housing main frame 11 formed cylindrically of an aluminum alloy material and a front plate 12 and a rear plate 13, each being made of an aluminum alloy material and closing a corresponding one of front and rear opening ends of housing main frame 11.

Housing main frame 11, front plate 12, and rear plate 13 are integrally coupled together from the axial direction by means of four bolts 14 and oil seals 45, 45' are fitted into annular grooves formed respectively on the front end surface of housing main frame 11 and the rear end surface thereof and grasped under pressure between each mutually opposing surfaces of front plate 12 and rear plate 13. Both of oil seals 45, 45' serve to block an oil leakage from each of retardation angle oil chambers 9 and advance angle oil chambers 10 as will be described later.

Housing main frame 11, as shown in FIGS. 2 and 3, includes a general section except each shoe 8 formed substantially thin and the plurality of working oil chambers formed in an inner part of main frame 11 are partitioned into each retardation angle oil chamber 9 and each advance angle oil chamber 10. Each shoe 8 is formed at substantially equal interval of distance in the circumferential direction of housing 5 and seal members 16, each being formed of a substantially 90° left inverted letter U shape (like a Japanese character of ⊐ ), are fitted into seal grooves formed on tip ends of respective shoes 8 along the axial direction of respective shoes 8. Four boss sections 17 are integrally installed at equal interval of distance in the circumferential direction of the outer periphery of housing main frame 11. Four bolt inserting holes 17*a* through which respective bolts 14 are inserted are penetrated axially through respective boss sections 17.

Furthermore, from among four shoes 8, circumferential widths of mutually adjacent two shoes 8*a*, 8*b* are relatively largely formed. These two shoes 8*a*, 8*b* serve to limit respective rotational positions of a maximum rightward direction (advance angle direction) and a maximum leftward direction (retardation angle direction) of vane member 7 by an appropriate contact of an opposing side surface of single wide vane 22 toward the advance angle side on an opposing side surface of one of two adjacent shoes 8*a* toward the retardation angle side and by the appropriate contact of another opposing side surface of single wide vane 22 toward the advance angle side on another opposing side surface of the other of two adjacent shoes 8*b* toward advance angle side, as shown in FIGS. 2 and 3.

Front plate 12 is formed in a disc shaped plate by means of press forming or so forth. As shown in FIG. 1, a large-diameter female screw hole 12*a* onto which an annular projection section 26*a* of a cap body 26 is liquid tightly screwed and fixed is drilled through a center of front plate 12. Four bolt inserting holes (not shown) are penetrated into which respective bolts 14 are inserted at an equal interval of distance in the circumferential direction of front plate 12 on the outer peripheral side of front plate 12.

In addition, as shown in FIG. 1, a retaining hole 50 which is a retaining section to fixedly retain one end section 51*a* of a torsion spring 51 as will be described later is drilled along the axial direction of camshaft 2 at a proximity to a hole edge of large diameter female screw hole 12*a*.

Rear plate 13 is formed in a slightly thinner disc shape than front plate 12 using an iron series metallic material, as shown in FIGS. 1 through 3. A large diameter inserting hole 13*a* in which a tip portion of one end section 2*a* of camshaft 2 is inserted relatively rotatably is drilled through the center section of rear plate 13. In addition, as shown in FIGS. 1 through 3, a cylindrical bearing 18 rotatably supported on an outer periphery of flange section 2*b* of camshaft 2 is projected at a hole edge outer peripheral side of large diameter inserting hole 13*a* of rear plate 13. Four first female screw holes 13*b* to which bolts 19 coupled with pulley member 6 are tightened are formed on the outer periphery of rear plate 13. In addition, four second female screw holes 13*c* into which respective bolts 14 are tightened are formed on the same circumference as each of first female holes 13*b*.

Furthermore, a lock hole 31 (engagement groove) of a lock mechanism is formed at a predetermined position of an inner surface of rear plate 13, as shown in FIG. 1.

Vane member 7 is formed integrally of the aluminum alloy material and, as shown in FIGS. 1 through 4, includes: an inserting hole 71 formed at a center position of vane member 7; a vane rotor 21 fixed onto a one end section 2*a* of camshaft 2 through the axial direction by means of cam bolt 15 inserted through inserting hole 7*a* of vane member 7 from the axial direction; and four vanes 22, 23, 24, 25 radially projected toward a radial direction at a substantially equal interval of distance in the circumferential direction of outer peripheral surface of vane rotor 21.

Vane rotor 21 is formed approximately cylindrically and extends toward camshaft side 2. A circular recess groove 21*a* having a relatively large diameter is formed at the center position of the front end side of vane rotor 21 and, on the other hand, a circular fitting groove 21*b* is formed on a rear end side of vane rotor 21 into which one end section 2*a* of camshaft 2 is fitted.

A spring housing space 38 which is part of a first connection section is formed in a space defined by an inner surface of recess groove 21*a*, a head section 15*a* of cam bolt 15, front plate 12, and cap body 26. A tip end surface of camshaft 2 is contacted under pressure in a liquid tight manner on a bottom surface of fitting groove 21*b* via an axial force of cam bolt 11.

Hence, when vane rotor 21 is tightened and is fixed to one end section 2*a* of camshaft 2 by means of cam bolt 15, a flange-like seat surface 15*c* integrally installed onto head section 15*a* of cam bolt 15 is contacted under pressure on the hole edge of bolt inserting hole 7*a* and the axial force of cam bolt 15 is acted upon camshaft 2 and vane rotor 21. Thus, vane rotor 21 can firmly be fixed to camshaft 2.

Figure 4:
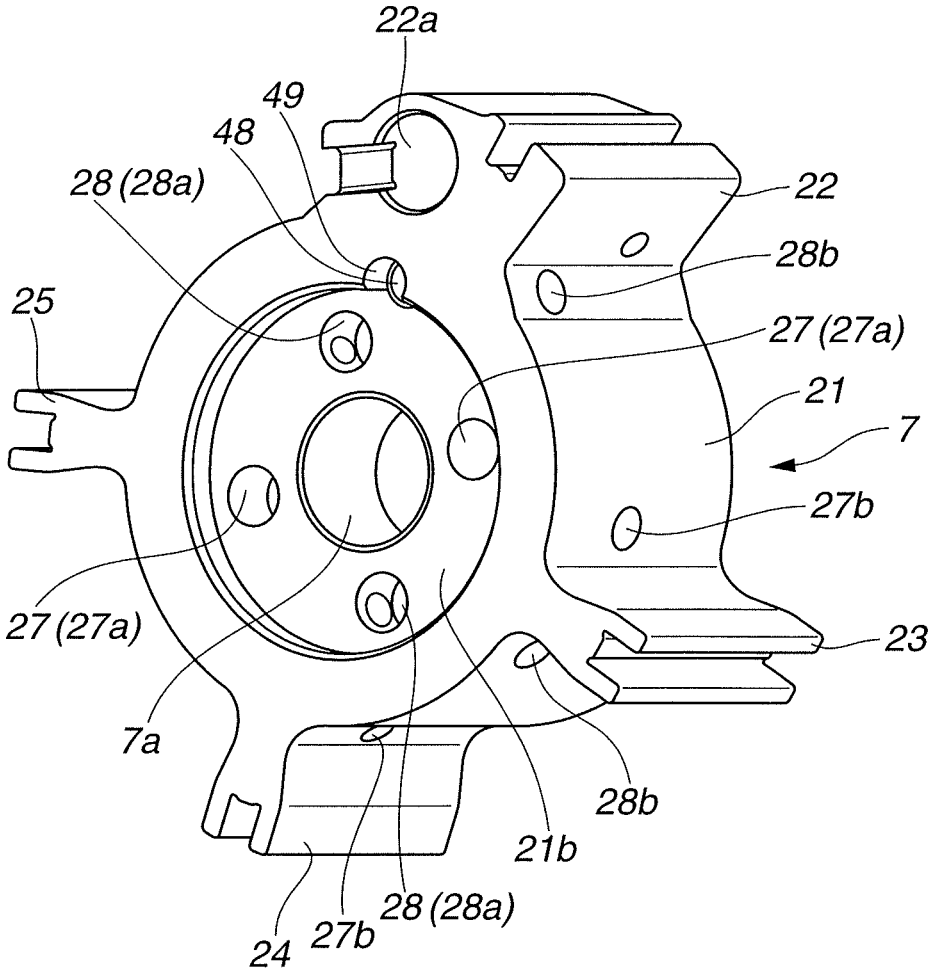
FIG. 4 is a perspective view of a vane member applicable to the preferred embodiment as viewed from a camshaft side.

In addition, vane rotor 21 is normally and reversely revolved while its outer peripheral surface of vane rotor 21 slidably moving on seal member 16 fitted into the upper surface of the tip end of each shoe 8 and each of a pair of retardation angle side oil holes 27, 27 and each of a pair of advance angle side oil holes 28, 28 which communicate between hydraulic circuit 4 and each of retardation angle oil chambers 9 and advance angle oil chambers 10 are formed on an inner part of vane rotor 21, as shown in FIGS. 1 and 4.

Each of the pair of retardation angle side oil holes 27, 27 is constituted by an axial hole and a radial hole which are bent in substantially letter L shape in the inner part of vane rotor 21. Each of the pair of advance angle side oil holes 28, 28 is constituted by the axial hole and the radial hole in the same way as each of the pair of retardation angle side oil holes 27, 27. Each of radial holes is branched into two in the inner part of vane rotor 21 to correspond to the four oil chambers 9, 10. Each of the axial holes has one end opening 27*a*, 28*a* formed to face a bottom surface side of fitting groove 21*b* of vane rotor 21. Each of the radial holes branched into two in the radial direction of vane rotor 21 from the other end of the corresponding one of the axial holes has outside openings 27*b*, 28*b* formed on an outer peripheral surface of vane rotor 21 and is exposed to each of retardation angle oil chambers 9 and each of advance angle oil chambers 10.

Each vane 22, 23, 24, 25 is disposed between each shoe 8 and substantially 90° left inverted letter U shape (like a Japanese character of) seal members 29 which slidably contact on an inner peripheral surface 11*a* of housing 11 are fitted within seal grooves formed axially on respective tip end surfaces of respective vanes 22, 23, 24, 25. Each vane 22, 23, 24, 25, as shown in FIGS. 2 and 3, is so structured that one 22 of four vanes which has a maximum width and the width of each of the remaining three vanes 23, 24, 25 is smaller (narrower) than one vane 22 whose width is the maximum and is set to the same width. Thus, the widths of respective vanes 22, 23, 24, 25 are respectively varied so that a revolution balance of the whole vane member 7 is uniformized.

A lock mechanism which restricts a free revolution of vane member 7 is installed between maximum width vane 22 and rear plate 13.

This lock mechanism, as shown in FIGS. 1 through 4, includes: a lock piston 30 slidably housed within sliding purpose hole 22*a* penetrated in an inner axial direction of maximum width vane 22 and disposed to enable a reciprocating motion with respect to rear plate 13 side; lock hole 31 (which is a limiting section) formed on rear plate 13, with which a tip end 30*a* of lock piston 30 is advanced (moved toward rear plate 13 side) and engaged, and from which the engagement of tip end section 30*a* of lock piston 30 is released when tip end section 30*a* is retracted (moved toward front plate 12 side); and an engagement-disengagement mechanism which engages lock piston 30 with lock hole 31 or releases (disengages) the engagement of lock piston 30 in accordance with a starting state of the engine.

Lock piston 30 is formed in a cylindrical pin shape and a large diameter section 30*b* at a rear end side of lock piston 30 with respect to rear plate 13 is slid in the liquid tight manner on an inner peripheral surface of a front end side large diameter section of sliding purpose hole 22*a*. In addition, a cut-out groove to secure a slidability is formed on a tip end of tip end section 30*a* along the radial direction of lock piston 30.

Lock hole 31 is formed largely in the axial direction of rear plate 13 and formed at a position offset toward advance angle side oil chamber 10 in the circumferential direction of one vane 22. In a case where tip end section 30*a* of lock piston 30 is engaged, the relative rotation position between housing 5 and vane member 7 is set to a position at a maximum advance angle side.

The above-described engagement-disengagement mechanism is elastically interposed between a rear end section of lock piston 30 and an inner end surface of front plate 12. The engagement-disengagement mechanism is constituted by: a coil spring 32 which is a biasing member to biased lock piston 30 toward the advance direction (the direction toward which lock piston 30 is engaged); and a release purpose hydraulic pressure circuit which retracts lock piston 30 (a release direction) by a supply of the hydraulic pressure within lock hole 31.

This release purpose hydraulic pressure circuit is mainly constituted by: lock hole 31 communicated with retardation angle oil chambers 9 and advance angle oil chambers 10 and retractably move lock piston 30 (move lock piston 30 away from lock hole 31) according to the hydraulic pressure at an inside of lock hole 31; a back pressure chamber 46 formed between the rear end surface of lock piston 30 and front plate 12 to discharge the hydraulic pressure inside thereof along with the retractable movement of lock piston 30; a communication groove 47 cut out at a front end surface of vane rotor 21 along the radial direction of vane rotor 21 and which is part of a first connection section communicated between back pressure chamber 46 and spring housing space 38; a communication hole 48 formed along an inner axis direction of vane rotor 21 and which is a back pressure passage whose one end is opened to spring housing space 38; and an exhaust hole 49 formed at the rear end side of vane rotor 21 and which is a second connection section to which an opening of the other end of communication hole 48 is exposed.

One end of communication hole 48 is opened to recess groove 21*a* of vane rotor 21 and exposed to spring housing space 38. The other end thereof is exposed to exhaust hole 49 via retardation angle side oil hole 27.

Exhaust hole 49 is formed cylindrically on the substantially same axle as communication hole 48 (substantially coaxial with communication hole 48) and a diameter of discharge hole 49 is set to be larger than communication hole 48. Together with the opening of the outer end side is communicated with drain passage 37 as will be described later via the oil passage not shown.

Then, lock piston 30 is retractably moved to release the lock with respect to lock hole 31 by means of the hydraulic pressure selectively supplied from retardation angle oil chambers 9 and advance angle oil chambers 10.

Hydraulic pressure circuit 4 selectively supplies the hydraulic pressure with respect to respective retardation angle oil chambers 9 and respective advance angle oil chambers 10 or discharges oil within respective oil chambers 9, 10. Hydraulic pressure circuit 4, as shown in FIG. 1, includes: a retardation angle passage 33 communicated with retardation angle side oil hole 27; an advance angle side passage 34 communicated with respective advance angle side oil holes 28; an oil pump 36 by which the hydraulic pressure is selectively supplied to respective passages 33, 34 via an electromagnetic valve 35; and a drain passage 37 which selectively communicates with respective passages 33, 34 via electromagnetic valve 35.

Retardation and advance angle passages 33, 34 are communicated with retardation and advance angle side oil holes 27, 28, respectively. Respective passages 33, 34 are formed in parallel to the inner axial direction of camshaft 2 via grooves 39*a*, 39*b* of bearings 03 from cylinder head 02 or from the inside of cylinder block (not shown).

Oil pump 36 is communicated with a supply passage 41, drain passage 36*a* of oil pump 36 being connected to an electromagnetic switching valve 35 via a filter 40, and a main oil gallery 42 to which a lubricating oil is supplied to a slide section of the engine, respectively. In addition, a relief valve 43 to suppress an excessive drain pressure is installed in oil pump 36.

Electromagnetic valve 35 is of a two way type valve and is configured to selectively control a switching between supply passage 41 located at a downstream of drain passage 36*a* of oil pump 36 and drain passage 37 in response to an output signal of a controller not shown.

The controller includes a computer at an inside of the controller. The controller inputs the information signals from various sensors such as a crank angle sensor, an airflow meter, a water (coolant) temperature sensor, a throttle valve opening angle sensor, and so forth (these sensors are not shown) to detect the present engine driving state. A control pulse current is outputted to an electromagnetic coil of an electromagnetic switching valve 35 in accordance with the engine driving state.

A torsion spring 51 is housed in the inner part of spring housing space 38, as shown in FIGS. 1 through 3.

This torsion spring 51 is disposed around an outer peripheral side of head section 15*a* of cam bolt 15 within recess groove 21*a*. One end section 51*a* of torsion spring 51 projected in the axial direction toward the front end side is engageably inserted and fixed to retaining hole 50 of front plate 12 and, on the other hand, other end section 51*b* projected in the axial direction toward the rear end side is engageably inserted and fixed within the tip end of communication hole 48.

These engageable insertions and fixations of both of one and other end sections 51*a*, 51*b* of torsion spring 50 cause a generation of a biasing force due to a torsional deformation of torsion spring so that a relative revolution phase of exhaust camshaft 2 with respect to timing pulley 1 is biased toward the advance angle side.

A gap between an outer peripheral surface of other end section 51*b* engageably inserted and fixed to communication hole 48 and communication hole 48 is formed so that this gap secures a speedy flow of discharge oil caused to flow from spring housing space 38 into communication hole 48.

Hereinafter, an action of the valve timing control apparatus (exhaust VTC) in the preferred embodiment according to the present invention will be described. At first, at a time immediately before the engine stop, the supply of the hydraulic pressure to retardation angle oil chambers 9 and advance angle oil chambers 10 is stopped and vane member 7 is relatively revolved toward a most advance angle position (an initial position) as shown in FIG. 2 so that lock piston 30 is advanced by means of coil spring 32 and tip end section 30*a* thereof is engaged within lock hole 31. Thus, the relative rotation of vane member 7 is limited.

Next, when an ignition switch is turned to ON to start the engine so that an engine cranking is started. At this time, the actuation of oil pump 36 is started. At the time immediately after the start, a drain pressure of oil pump 36 does not sufficiently rise so that the oil supply quantity to exhaust VTC becomes insufficient. However, as shown in FIG. 2, tip end section 30*a* of lock piston 30 is previously inserted into lock hole 31 so that vane member 7 is restricted in its revolution position at the most advance angle side optimum for the start. Thus, a favorable startability can be obtained by such a smooth cranking as described above and a rattling of respective members constituting vane member 7 due to an alternating torque acted upon exhaust camshaft 2 can be suppressed.

In a predetermined low-revolution-and-low-load region after the engine start, the controller interrupts a power supply of an electromagnetic coil of electromagnetic switching valve 35. Thus, at the same time when drain passage 36*a* (supply passage 41) of oil pump 36 is communicated with advance angle side passage 34, retardation angle side passage 33 is communicated with drain passage 37.

Thus, the working oil drained from oil pump 36 is caused to flow into respective advance angle oil chambers 10 via advance angle side passage 34 to provide high pressure advance angle oil chambers 10. On the other hand, the working oil within retardation angle oil chambers 9 is discharged to an oil pan 44 from drain passage 37 via retardation angle side passage 36 to provide low pressure within respective retardation angle oil chambers 9.

At this time, since the working oil caused to flow into respective advance angle oil chambers 10 is supplied to lock hole 31 of the lock mechanism, lock piston 30 is retractably moved from lock hole 31 to release the lock. In details, oil within back pressure chamber 46 is caused to flow from communication groove 47 into spring housing space 38 along with the retractable movement of lock piston 30 and caused to flow into exhaust hole 49 via the gap between the inner peripheral surface of communication hole 48 and the outer peripheral surface of other end section 51*b* of torsion spring 51 and is drained to drain passage 37 via the oil passage. Thus, a speedy retractable movement of lock piston 30 can be secured.

The release of lock by means of lock piston 30 is made so that vane member 7 can arbitrarily modify the open-and-closure timing of the exhaust valve by allowing a free revolution. In this state, vane member 7 is held at the most advance angle side.

On the other hand, in a case where the engine driving state is transferred to, for example, a middle revolution region, the controller outputs a predetermined duty control current to electromagnetic switching valve 35 to communicate drain passage 36*a* with retardation angle side passage 33 and, at the same time, to communicate advance angle side passage 34 with drain passage 37.

Thus, the working oil within respective advance angle oil chambers 10 are discharged to provide low pressure oil chambers and the working oil is supplied to respective retardation angle oil chambers 9 to provide high pressure (retardation angle) oil chambers. At this time, the hydraulic pressure is supplied from respective retardation angle oil chambers 9 to lock hole 31. Hence, since the hydraulic pressure is supplied from respective retardation angle oil chambers 9 to lock hole 31, lock piston 30 maintains the state extracted from lock hole 31 (maintains the release state).

Therefore, vane member 7, as shown in FIG. 3, rotates toward a counterclockwise direction with respect to housing 5 and a relative pivotal phase of camshaft 2 with respect to timing pulley 1 is converted into the retardation angle side.

Consequently, the open-and-closure timing of the exhaust valve is controlled to be toward the retardation angle side so that a valve overlap between intake valve and exhaust valve becomes large. Thus, an engine combustion efficiency in the middle revolution region can be improved.

When the supply of hydraulic pressure from respective oil chambers 9, 10 to lock hole 31 with oil pump 36 stopped is interrupted while the engine is stopped, oil within lock hole 31 is exhausted from either one of retardation and advance angle oil chambers 9, 10 to drain passage 37. Then, lock piston 30 is biased toward the direction of lock hole 31 by means of the spring force of coil spring 32.

Then, since, in the preferred embodiment, as described above, the spring force of torsion spring 51 biases the vane member 7 toward the advance angle direction. Hence, since the valve open-and-closure timing of the exhaust valve at the time of engine stop can forcibly be controlled toward the most advance angle side, the startability of the engine can become favorable as described before.

In addition, other end section 51*b* of torsion spring 51 is engageably inserted and fixed (fixedly retained) to communication hole 51 utilizing its function and structure of communication hole 51. Therefore, it is not necessary to form a special exclusive retaining groove to which other end section 51*b* of torsion spring 51 is fixedly retained. Therefore, a manufacturing work of the valve timing control apparatus becomes easier and achieves a reduction of manufacturing cost.

Furthermore, torsion spring 51 is housed compactly within spring housing space 38. A magnitude of a radial directional length of the valve timing control apparatus can be reduced and an axial directional length thereof can be shortened.

Torsion spring 51 is housed within spring housing space 38 formed by recess groove 21*b*. Thus, even in a case where torsion spring 51 is slanted in the forward-and-rearward direction with respect to the axial to direction, recess groove 21*b* provides a guide to enable a suppression of a large inclination of torsion spring 51.

Furthermore, housing 3 is sealed in the liquid tight manner by means of respective oil seals 45, 45' and a liquid tight coupling is performed between the front end is surface of camshaft 2 and vane rotor 21 according to the pressure contact of the axial force of cam bolt 15. Hence, an unintentional leakage of oil within housing 3 can sufficiently be blocked.

The present invention is not limited to the structure of the preferred embodiment. It is possible to apply the present invention to an intake valve (side) valve timing control apparatus other than the exhaust valve (side) valve timing control apparatus. In this case, torsion spring 51 can bias vane member 7 toward the retardation angle side at a time of the engine stop.

In addition, the present invention cab be applied to the valve timing control apparatus other than the vane type valve timing control apparatus.

The technical ideas of the present invention graspable from the preferred embodiment according to the present invention will, hereinafter, be explained.

1) A valve timing control apparatus for an internal combustion engine, comprises: a housing to which a turning force is transmitted from a crankshaft via a timing belt and at an inner peripheral side of which a plurality of working oil chambers are disposed; a vane member coupled to a tip end of a camshaft and relatively rotatably disposed within the housing; a lock piston disposed axially movably in an inner part of the vane member and whose axial tip end is retractably advanced toward a rear side of the camshaft; a biasing member disposed within a back pressure chamber disposed in a front side of the camshaft opposite to the camshaft to bias the lock piston to be advanced toward the rear side of the camshaft; a limiting section on which the axial tip end of the lock piston is contacted to limit a relative rotation of the vane member to the housing; a communication hole formed in an inner is axial direction of the vane member to introduce a working oil within the back pressure chamber into the engine; and a torsion spring whose one end section is fixed into the front side of the housing and other end section is fixedly retained into the communication hole to bias the vane member to rotate in one direction.

2). The valve timing control apparatus for the internal combustion engine as set forth in item 1), wherein the housing is rotatably journalled the camshaft side with respect to the housing member.

According to the present invention described in item 2), the housing is rotatably journalled on the camshaft side via the vane member and the tip end section (30*a*) of lock piston (30) is contacted on the limiting section (31) at this journalled section (bearing section) side. Hence, even if the housing (5) is pivoted (oscillated) with this journalled section (bearing section) as a fulcrum, its inclination angle of the housing with respect to the camshaft becomes small. Therefore, it becomes possible to engage the tip end of the lock piston accurately at an appropriate position of the engagement groove (lock hole 31) without a positional deviation (positioning error) when the tip end section of lock piston (30) is engaged into the engagement groove (31) as the limiting section.

3). The valve timing control apparatus for the internal combustion engine as set forth in item 1), wherein the lock piston is disposed within the vane member and a first connection section constituted by a cylindrical recess section and a groove extended from the recess section toward an outer peripheral side and communicated with the back pressure chamber is provided between the communication hole and the back pressure chamber.

4). The valve timing control apparatus for the internal combustion engine as set forth in item 1), wherein the other end section of the torsion spring is engageably inserted and fixed to one end section of the communication hole at the front side.

5). The valve timing control apparatus for the internal combustion engine as set forth in item 4), wherein the other end of the communication hole at the rear side is disposed in a proximity to an attachment section of the vane member to the tip end of the camshaft According to the present invention described in item 5), the working oil exhausted from the back pressure chamber to the communication hole is speedily discharged to an inside of the engine from the other end section at the rear side via the drain passage at the inside of the camshaft. It should be noted that driving rotary body corresponds to timing sprocket (timing pulley) 1, driven rotary body corresponds to camshaft 2 and vane member 7, the first connection section corresponds to spring housing space 38 and communication groove 47, and the back pressure passage corresponds to communication hole 48.

This application is based on a prior Japanese Patent Application No. 2010-286906 filed in Japan on Dec. 24, 2010. The entire contents of this Japanese Patent Application No. 2010-286906 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a housing to which a turning force is transmitted from a crankshaft via a timing belt and at an inner peripheral side of which a plurality of working oil chambers are disposed;

a vane member coupled to one end of a camshaft and relatively rotatably disposed within the housing;

a lock piston disposed axially movably in an inner part of the vane member and whose axial tip end is retractably advanced toward a rear side of the camshaft;

a biasing member disposed within a back pressure chamber disposed in front of the camshaft and opposite to the camshaft to bias the lock piston to be advanced toward the rear side of the camshaft;

a limiting section on which the axial tip end of the lock piston is contacted to limit a relative rotation of the vane member to the housing;

a communication hole formed in the vane member, and being structurally configured to introduce a working oil within the back pressure chamber into an oil pan via a drain passage; and a torsion spring whose one end section is fixed into the front side of the housing and whose other end section is fixedly retained into the communication hole, the torsion spring being structurally configured to bias the vane member to rotate in one direction.

2. The valve timing control apparatus for the internal combustion engine as claimed in claim 1, wherein the housing is rotatably journalled on the camshaft side with respect to the housing member.

3. The valve timing control apparatus for the internal combustion engine as claimed in claim 1, wherein the lock piston is disposed within the vane member and a first connection section constituted by a cylindrical recess section and a groove extended from the recess section toward an outer peripheral side and communicated with the back pressure chamber is provided between the communication hole and the back pressure chamber.

4. The valve timing control apparatus for the internal combustion engine as claimed in claim 1, wherein the other end section of the torsion spring is engageably inserted and fixed to one end section of the communication hole at the front side.

5. The valve timing control apparatus for the internal combustion engine as claimed in claim 4, wherein the other end of the communication hole at the rear side is disposed in a proximity to an attachment section of the vane member to the tip end of the camshaft.

6. A valve timing control apparatus for an internal combustion engine, comprising:

a driving rotary body to which a turning force is transmitted from a crankshaft via a timing belt;

a driven rotary body fixed to one end of the camshaft and installed relatively rotatably on the driving rotary body;

a lock piston installed in one of the driving rotary body and the driven rotary body to be retracted when a quantity of a supplied working liquid to the apparatus is equal to or larger than a predetermined quantity and to be advanced when the quantity of the supplied working liquid is smaller than the predetermined quantity;

a biasing member for biasing the lock piston to be advanced;

a limiting section installed on the other side of the driving rotary body and the driven rotary body and on which a tip end section of the lock piston is contacted to limit a relative revolution of the driven rotary body to the driving rotary body;

a back pressure chamber installed on the one side of the driven rotary body to the driving rotary body and in an inside of which the biasing member is housed;

a back pressure passage formed in one of the rotary bodies, and being structurally configured to introduce a working oil within the back pressure chamber into an oil pan via a drain passage; and a torsion spring one end thereof being engageably inserted and fixed onto a position constituting part of the back pressure passage and the other end thereof being fixed onto either one of the driving and driven rotary bodies on which the back pressure chamber is formed.

* * * * *